US007152442B2

(12) United States Patent
Char et al.

(10) Patent No.: US 7,152,442 B2
(45) Date of Patent: Dec. 26, 2006

(54) METHOD FOR INSTALLING A STORM DOOR MORTISE LOCK INCLUDING A SEPARATE KEY CYLINDER

(76) Inventors: Frank Char, 2V Tower 9, Tian Tian, Hong Kong (HK); Huang Xiang Xiang, 388 Feng Quang Row, Chong Xing Town, Guang Doang (HK); Liang Xiao Ming, 2V Tower 9, Tian Tian, Hong Kong (HK)

( * ) Notice: Subject to any disclaimer, the term of this patent is extended or adjusted under 35 U.S.C. 154(b) by 0 days.

(21) Appl. No.: 10/445,782

(22) Filed: May 27, 2003

(65) Prior Publication Data

US 2003/0192355 A1 Oct. 16, 2003

Related U.S. Application Data

(62) Division of application No. 10/012,078, filed on Dec. 8, 2001, now abandoned.

(51) Int. Cl.
*E05D 59/00* (2006.01)
*E05D 63/14* (2006.01)

(52) U.S. Cl. ..... 70/107; 70/370; 70/451; 70/462; 292/244

(58) Field of Classification Search ..... 70/107–111, 70/370, 451, 466, 462; 292/244
See application file for complete search history.

(56) References Cited

U.S. PATENT DOCUMENTS

| | | | | | |
|---|---|---|---|---|---|
| 1,334,292 | A | * | 3/1920 | Cox | 70/493 |
| 2,380,708 | A | | 7/1945 | Schlage et al. | |
| 2,725,960 | A | * | 12/1955 | Milone | 49/505 |
| 2,938,373 | A | * | 5/1960 | Gray et al. | 70/86 |
| 3,039,291 | A | * | 6/1962 | Dusing et al. | 70/451 |
| 3,582,121 | A | | 6/1971 | Rollins | 292/170 |
| 3,917,329 | A | | 11/1975 | Fujiki et al. | 292/163 |
| 3,999,789 | A | * | 12/1976 | Maurits et al. | 292/34 |
| 4,109,494 | A | * | 8/1978 | Allemann | 70/107 |
| 4,129,019 | A | * | 12/1978 | Urdal | 70/107 |
| 4,156,541 | A | * | 5/1979 | Babb et al. | 292/21 |
| 4,236,396 | A | | 12/1980 | Surko, Jr. et al. | 70/107 |
| 4,333,324 | A | | 6/1982 | Dietrich et al. | 70/107 |
| 4,492,101 | A | * | 1/1985 | Tanaka | 70/370 |
| 4,606,203 | A | | 8/1986 | Esser | 70/107 |
| 4,696,174 | A | * | 9/1987 | Marks | 70/451 |
| 4,899,563 | A | | 2/1990 | Martin | 70/370 X |
| 4,986,576 | A | | 1/1991 | Anderson | 292/40 |
| 5,077,992 | A | | 1/1992 | Su | 70/107 |

(Continued)

FOREIGN PATENT DOCUMENTS

| | | | |
|---|---|---|---|
| GB | 1432817 | 4/1976 | 70/107 |

*Primary Examiner*—Lloyd A. Gall
(74) *Attorney, Agent, or Firm*—McKee, Voorhees & Sease, P.L.C.

(57) ABSTRACT

A method for installing a storm door with a mortise lock that includes a lock body having opposed side plates with a dead bolt assembly and a live bolt assembly intermediate the side plates wherein a key cylinder is separate from the cam. A thumb turn button and key cylinder are secured to opposite escutcheon plates and the cam is separately secured between the side plates of the mortise lock body. The key cylinder includes one or more key pins in the key cylinder housing and preferably in the decorative portion thereof. A spindle traverses from the key cylinder through the cam through hole and terminates in the mounting slot of the thumb turn button.

2 Claims, 9 Drawing Sheets

U.S. PATENT DOCUMENTS

| | | | | | |
|---|---|---|---|---|---|
| 5,201,200 | A | | 4/1993 | Hauber | 70/107 |
| 5,410,899 | A | | 5/1995 | McConnell | 70/370 |
| 5,479,802 | A | * | 1/1996 | Miller | 70/443 |
| 5,548,981 | A | * | 8/1996 | Kirk | 70/58 |
| 5,634,508 | A | * | 6/1997 | Herbst | 160/371 |
| 5,636,540 | A | | 6/1997 | Myers | 70/370 |
| 5,820,177 | A | | 10/1998 | Moon | 292/335 |
| 5,931,035 | A | | 8/1999 | Bolton | 70/367 |
| 6,170,305 | B1 | | 1/2001 | Shen | 70/107 |
| 6,322,113 | B1 | | 11/2001 | Ayers et al. | 292/336.3 |
| 6,655,108 | B1 | * | 12/2003 | Larson et al. | 52/784.1 |
| 6,688,063 | B1 | * | 2/2004 | Lee et al. | 52/455 |
| 2003/0033839 | A1 | * | 2/2003 | Chen et al. | 70/107 |

* cited by examiner

METHOD FOR INSTALLING A STORM DOOR MORTISE LOCK INCLUDING A SEPARATE KEY CYLINDER

CROSS-REFERENCE TO RELATED APPLICATIONS

This application is a divisional of application Ser. No. 10/012,078 filed on Dec. 8, 2001 now abandoned.

BACKGROUND OF THE INVENTION

1. Field of the Invention

The present invention generally relates to a storm door including a mortise lock and more specifically to a mortise lock for a storm door that includes a dead bolt lock with a separate key cylinder mounted on an escutcheon plate for easy installation.

2. Prior Art

Storm door mortise locks typically have a dead bolt that is activated by an integrally connected key cylinder body. The typical key cylinder body 10 of the prior art, shown in FIG. 1, includes the common mechanics of a standard key cylinder 12 opposite from a thumb turn button 14. The key cylinder 12 and the thumb turn button 14 are connected to a cam 16 within the key cylinder body 10. The cam 16 can be rotated by either turning the thumb turn button 14 or by only by use of the correct key in the key cylinder 12.

The key cylinder body 10 has a profile that makes installation of the prior art mortise locks difficult. Installation of the key cylinder body 10 requires that a rectangular cut be stamped into the face of the door. For simplicity and cost saving reasons, round holes are preferred. However, the unusual shape of the key cylinder body 10 of the prior art would require a round hole with a diameter so large that the hole would require significant additional hardware, such as widened escutcheon plates to cover the hole, making the latch less aesthetically pleasing. Rather than make such a large round hole, currently, a rectangular slot is made on both sides of the door face.

Making this slot requires special tools and is much more difficult, time intensive and expensive than simple drilling. Because of the expense and special tooling required, preparation of current mortise lock cuts is typically done by the storm door manufacturer. The manufacturer would save valuable time and money if the mortise locks could be installed on-site. There is therefore a need for a mortise lock that allows for installation using normal drilling techniques.

Further, typical storm doors, using a conventional mortise lock body, allow for the reversal of the storm door, for use in either right or left hand hinges. However, because of the difficulty of installing the mortise locks of the prior art, the only practical way to reverse the storm door is by flipping the door. Flipping the door is burdensome and may not always be aesthetically pleasing. There is therefore a need for a mortise lock that allows the installer to use the door in either right or left hand hinges without flipping the door.

There is therefore a need for a storm door with a mortise lock that avoids these and other problems.

FEATURES OF THE PRESENT INVENTION

A general feature of the present invention is the provision of a method for installing a storm door with a mortise lock which overcomes the problems found in the prior art.

A further feature of the present invention is the provision of a method for installing a storm door with a mortise lock in which the amount of door face preparation and associated costs are minimized.

Another feature of the present invention is the provision of a method for installing a storm door with a mortise lock in which the mortise lock may be installed by drilling standard round bore holes.

A further feature of the present invention is the provision of a method for installing a storm door with a mortise lock in which the key cylinder is separate from the cam.

A still further feature of the present invention is the provision of a method for installing a storm door with a mortise lock in which the key cylinder may be mounted to the escutcheon plate.

These, as well as other features and advantages of the present invention, will become apparent from the following specification and claims.

BRIEF SUMMARY OF THE INVENTION

The present invention generally comprises a method for providing a storm door with a mortise lock. The mortise lock may be either a reversible mortise lock or a solid core mortise lock. The mortise lock includes a lock body having opposed side plates with a dead bolt assembly and a live bolt assembly intermediate the side plates. The bolts slide between retracted and extended positions beyond the edge of the door. The mortise lock of the present invention also includes a cam, a thumb turn button, and a key cylinder. The thumb turn button and key cylinder are secured to opposite escutcheon plates and the cam is separately secured between the two side plates of the mortise lock. A spindle operatively links the key cylinder, cam and thumb turn button. Because these parts are separate, they can be used in storm doors of varying thicknesses by only changing the length of the spindle used.

By securing only the cam between the two side plates, the overall thickness of the lock body can be minimized. Further, by having a separate key cylinder, there is greater flexibility in mortise lock configurations. Preferably, the key cylinder of the present invention includes a plurality of pins within the decorative portion of the key cylinder housing and in the decorative portion thereof. By locating the pins in the key cylinder housing, the overall length of the key cylinder is shortened.

During installation, a mortise for the mortise lock is made. Next, a conventional drill may be used to make the necessary holes for the key cylinder and thumb turn button. This minimizes both the installation time required and the associated costs. Further, because preparation can now be performed with ordinary drills, installation and face preparation can be done on-site. This saves the manufacturer valuable time and money when preparing the storm door. These features of novelty and various other advantages that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

Referring now to the drawings, wherein like reference numerals indicate corresponding structure throughout the several views.

DETAILED DESCRIPTION OF THE INVENTION

The present invention will be described as it applies to its preferred embodiment. It is not intended that the present invention be limited to the described embodiment. It is intended that the invention cover all modifications and alternatives which may be included within the spirit and scope of the invention.

Figure 1:
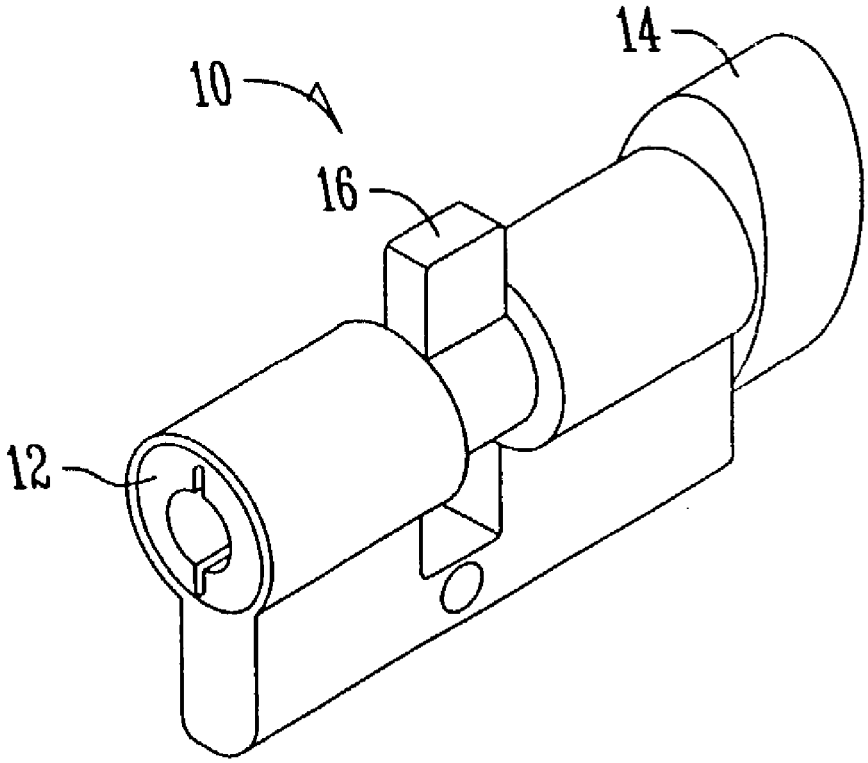
Fig. 1 (PRIOR ART)
FIG. 1 is a perspective view of a prior art key cylinder body.
Figure 2:
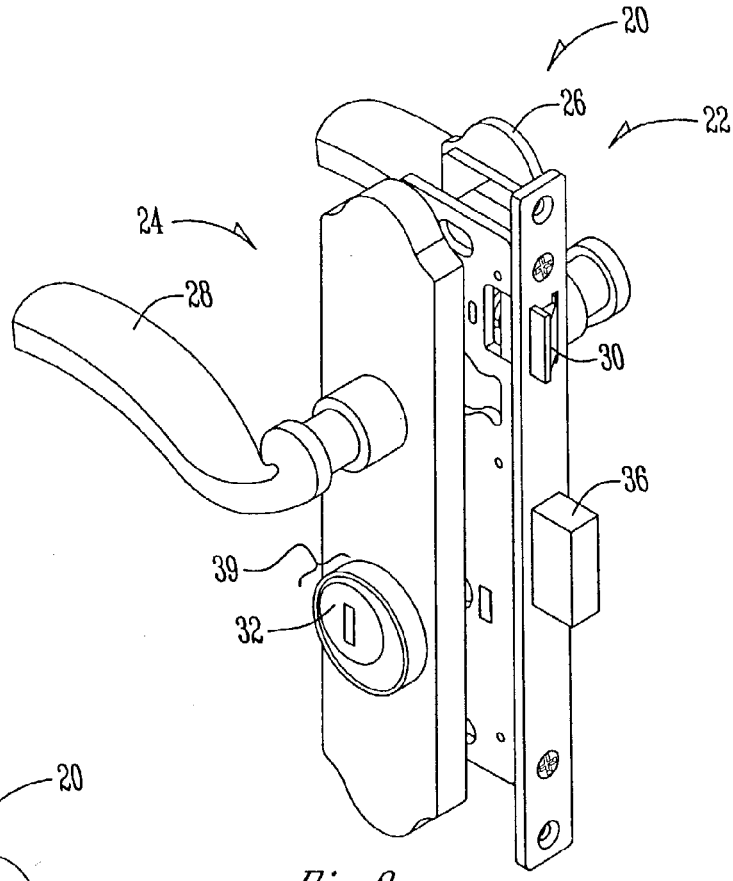
FIG. 2 is a front top perspective view of a mortise lock according to the principles of the present invention.
Figure 3:
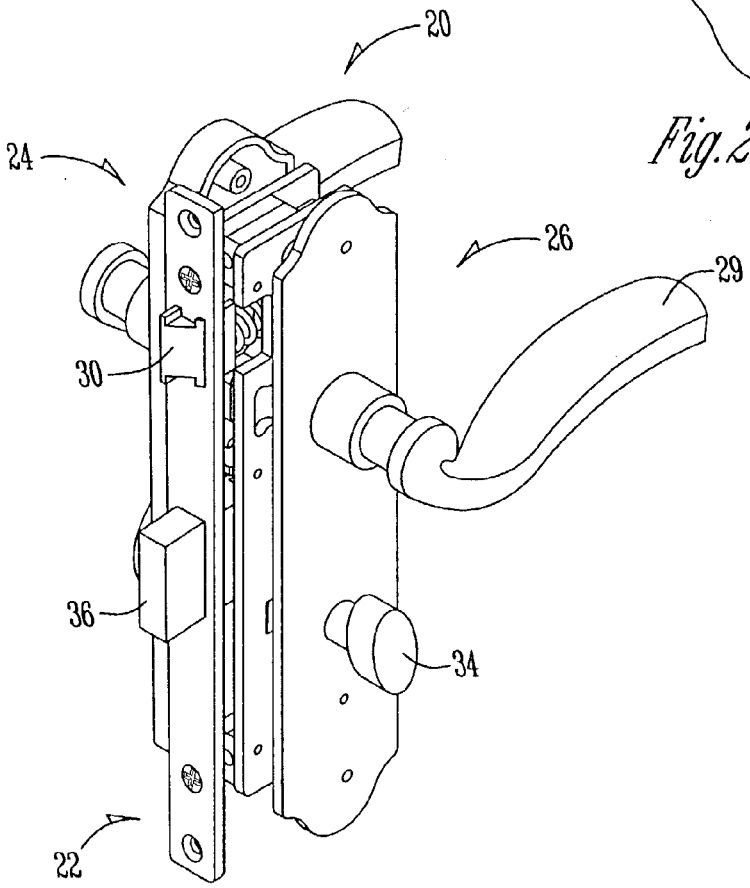
FIG. 3 is a rear top perspective view of the mortise lock shown in FIG. 2.

Referring now to the drawings, wherein like reference numerals and letters indicate corresponding structure throughout the several views, and referring in particular to FIGS. 2 and 3, there is shown a mortise lock 20 according to the present invention. The mortise lock 20 preferably includes a lock body 22, exterior escutcheon assembly 24 and interior escutcheon assembly 26. The exterior escutcheon assembly 24 has a handle 28 to actuate the live bolt assembly 30. The key cylinder 32, used to turn the dead bolt assembly 36, is also part of the exterior escutcheon assembly 24. The interior escutcheon assembly 26 also includes a handle 29 to actuate the live bolt assembly 30. A thumb turn button 34 is also provided to turn the dead bolt assembly 36. The live bolt assembly 30 and the dead bolt assembly 36 are secured to the lock body 22.

Figure 4:
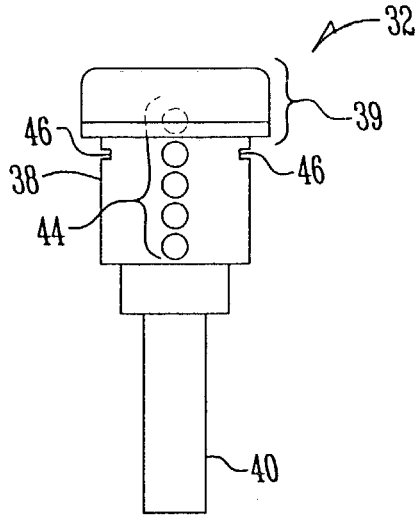
FIG. 4 is a bottom view of the mortise key cylinder of the present invention.
Figure 5:
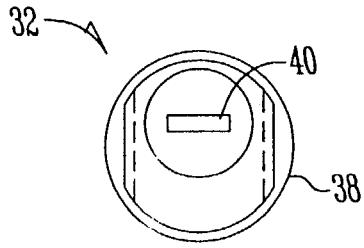
FIG. 5 is a rear view of the mortise key cylinder shown in FIG. 4.
Figure 6:
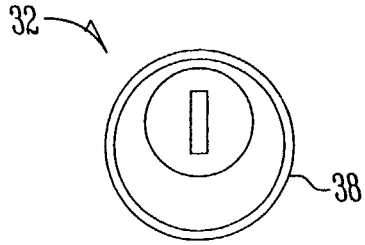
FIG. 6 is a front view of the mortise key cylinder shown in FIG. 4.

As is shown in FIGS. 4 through 6, the key cylinder 32 of the present invention is separate from and does not include the cam 58. By separating the key cylinder 32 from the cam 58, the cross-sectional profile of the key cylinder 32 can be minimized. As shown, the cross-sectional profile of the key cylinder 32 is generally circular. This allows for circular installation holes to be drilled by conventional methods using commonly available tools. Using commonly available tools reduces the overall time and corresponding costs needed to prepare the face of the storm door 18. A spindle 40 is rotatably secured to the key cylinder 32. The key pin or pins 44 are incorporated within the key cylinder housing 38 as shown in FIG. 4. Preferably, at least one pin 44 is included in the decorative portion 39 of the key cylinder housing 38. This allows the overall length of the key cylinder 32 to be kept to a minimum, thereby making the exposed portion of the key cylinder 32 more aesthetically pleasing. The key cylinder housing also includes one or more channels 46.

Figure 7:
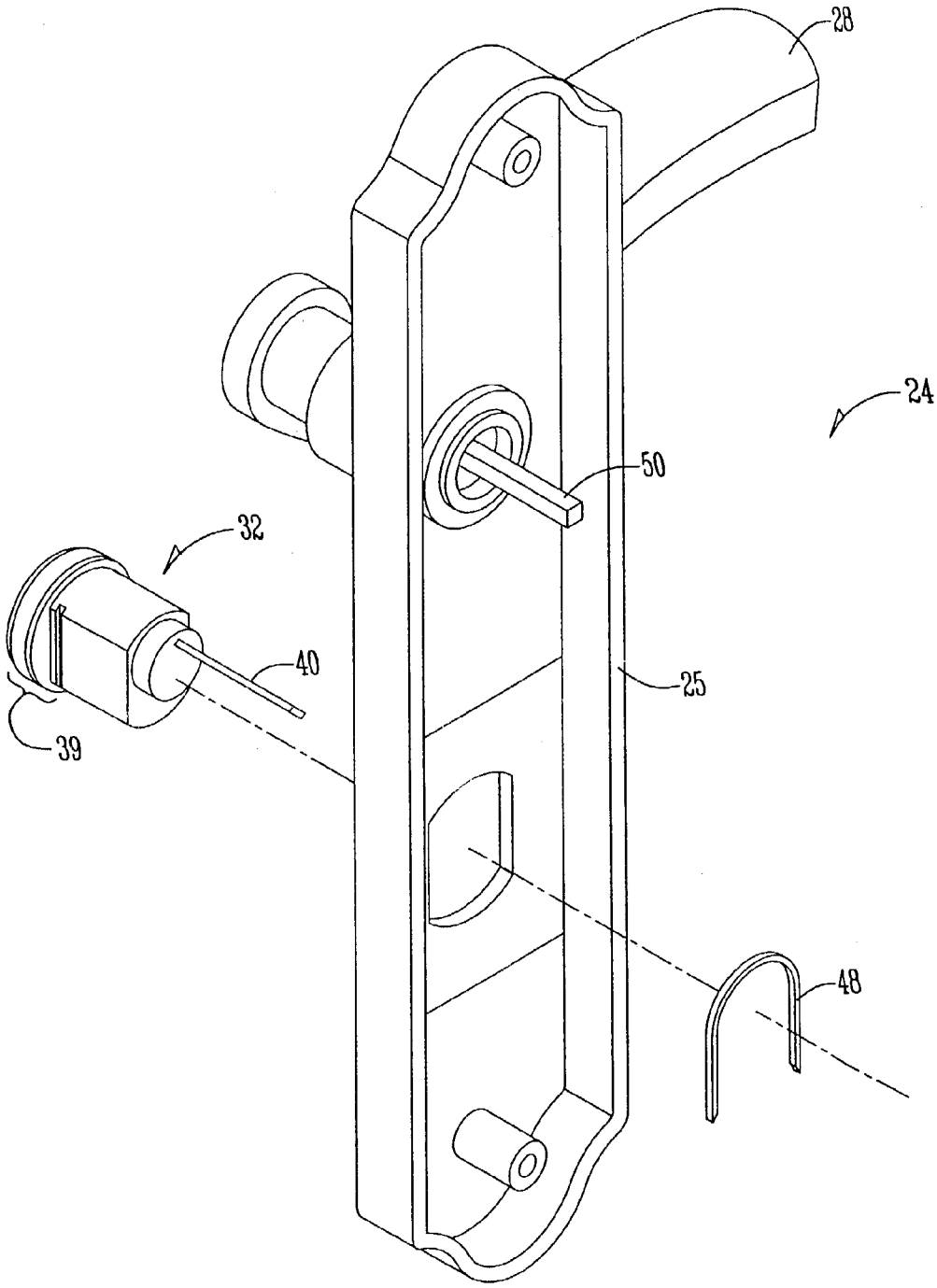
FIG. 7 is a partial exploded perspective view of the exterior escutcheon plate assembly.

The key cylinder 32 is secured to the exterior escutcheon plate 25 as shown in FIG. 7. A retaining clip 48 fits within the channels 46 to hold the key cylinder 32 to the exterior escutcheon plate 25. FIG. 7 also shows the handle spindle 50 installed in the handle 28 of the exterior escutcheon assembly 24.

Figure 8:
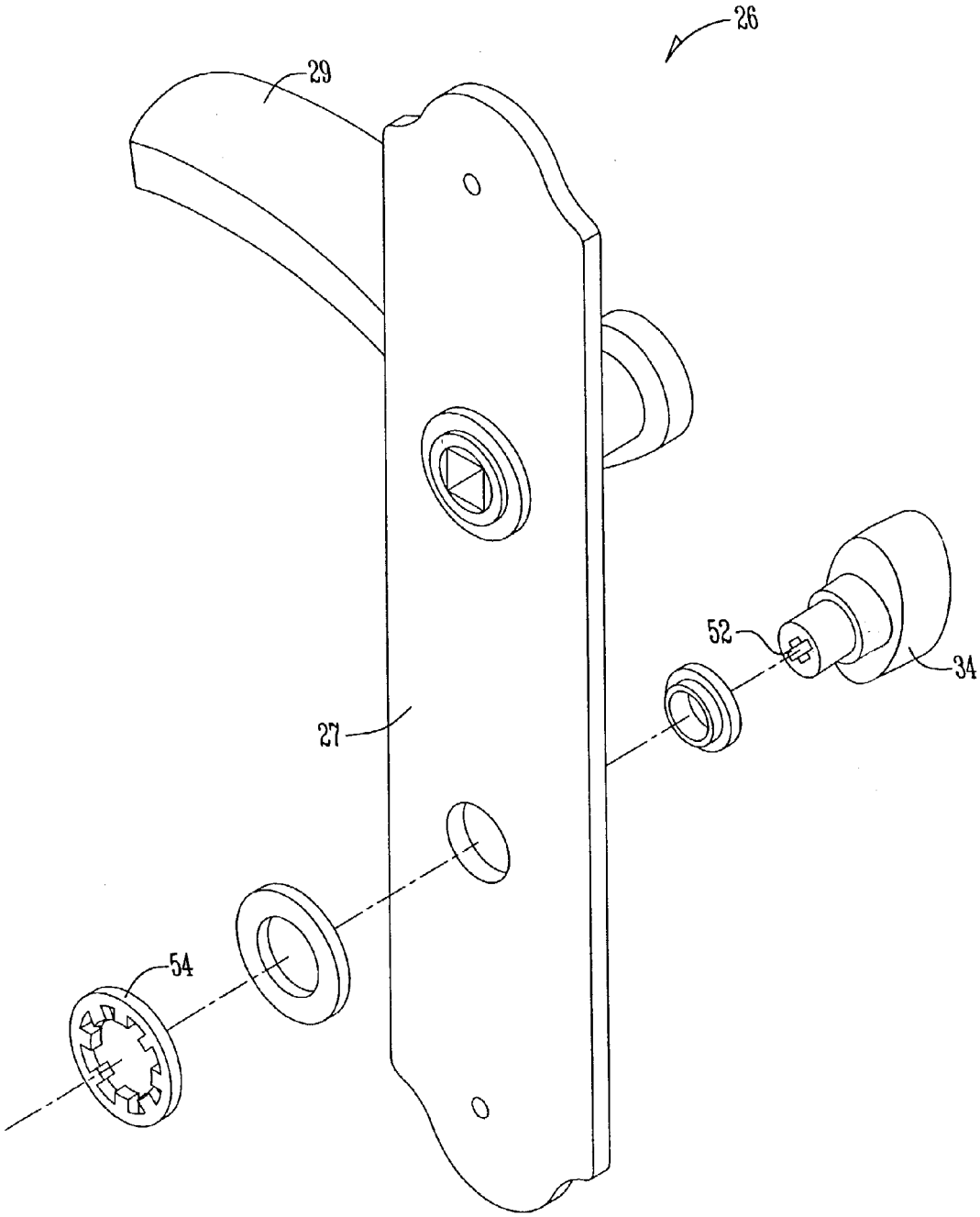
FIG. 8 is a partial exploded perspective view of the interior escutcheon plate assembly.

The interior escutcheon assembly 26 is shown in FIG. 8. The interior escutcheon assembly includes a handle 29 rotatably secured to the interior escutcheon plate 27. The handle 29 is adapted to receive the handle spindle 50 previously installed in the exterior escutcheon assembly 24. The thumb turn button 34 is preferably rotatably secured to the interior escutcheon plate 27 by a retaining ring 54. The thumb turn button 34 includes at least one mounting slot 52 for receiving the spindle 40. By having a plurality of slots 52, the installer can best determine the proper orientation of the thumb turn button 34.

Figure 9:
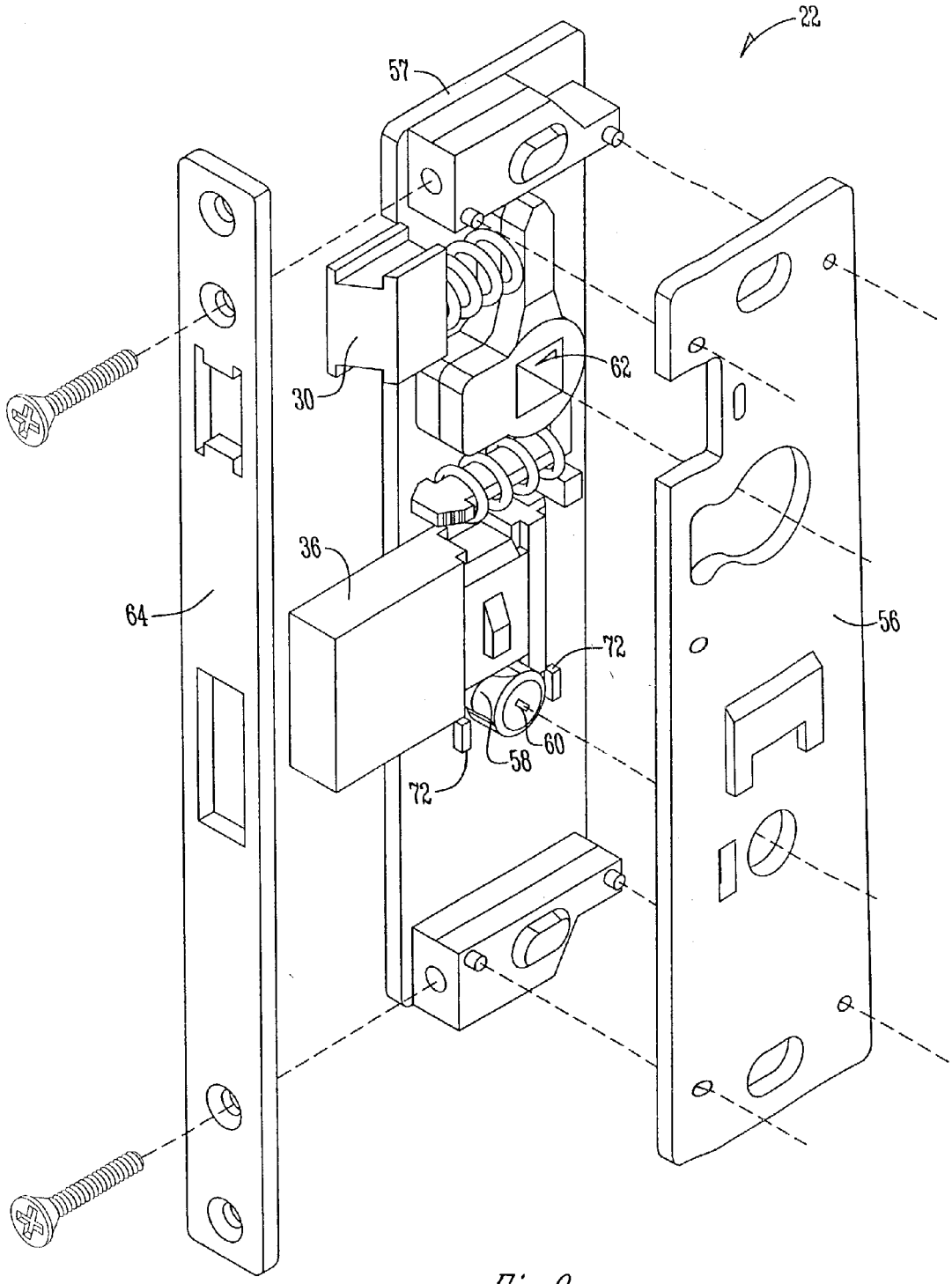
FIG. 9 is a partial exploded perspective view of the mortise lock body of the present invention.

The lock body 22 is shown in FIG. 9. The lock body 22 includes a cam 58 rotatably secured between two side plates 56 and 57. The cam 58 includes a cam through hole 60. When installed, the spindle 40 passes through the cam through hole 60 and into the thumb turn button 34 such that turning of either the key cylinder 32, by a corresponding key (not shown), or the thumb turn button 34 will turn the cam 58 and actuate the dead bolt assembly 36.

Figure 10:
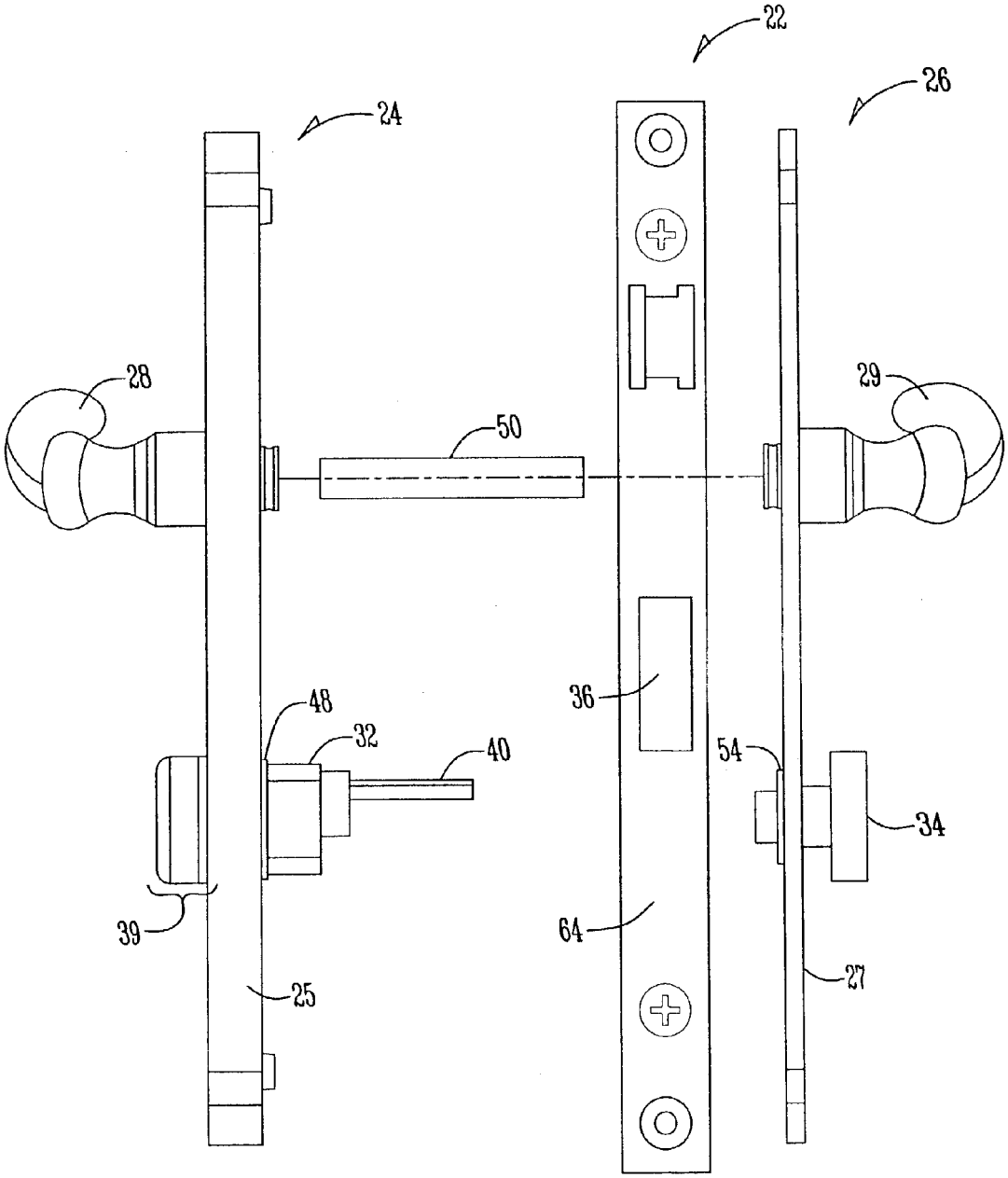
FIG. 10 is a partial exploded side view of the mortise lock of the present invention.

The lock body 22 also includes the live bolt assembly 30 that includes a slot 62 for receiving the handle spindle 50. When properly installed, the handle spindle 50 will be operatively connected to the handle 28 on the exterior escutcheon assembly 24 and the handle 29 on the interior escutcheon assembly 26, such that rotation of either handle 28 or 29 will actuate the live bolt assembly 30. The proper alignment of the lock body 22, the interior escutcheon assembly 26 and the exterior escutcheon assembly 24 is shown in FIG. 10.

Figure 11:
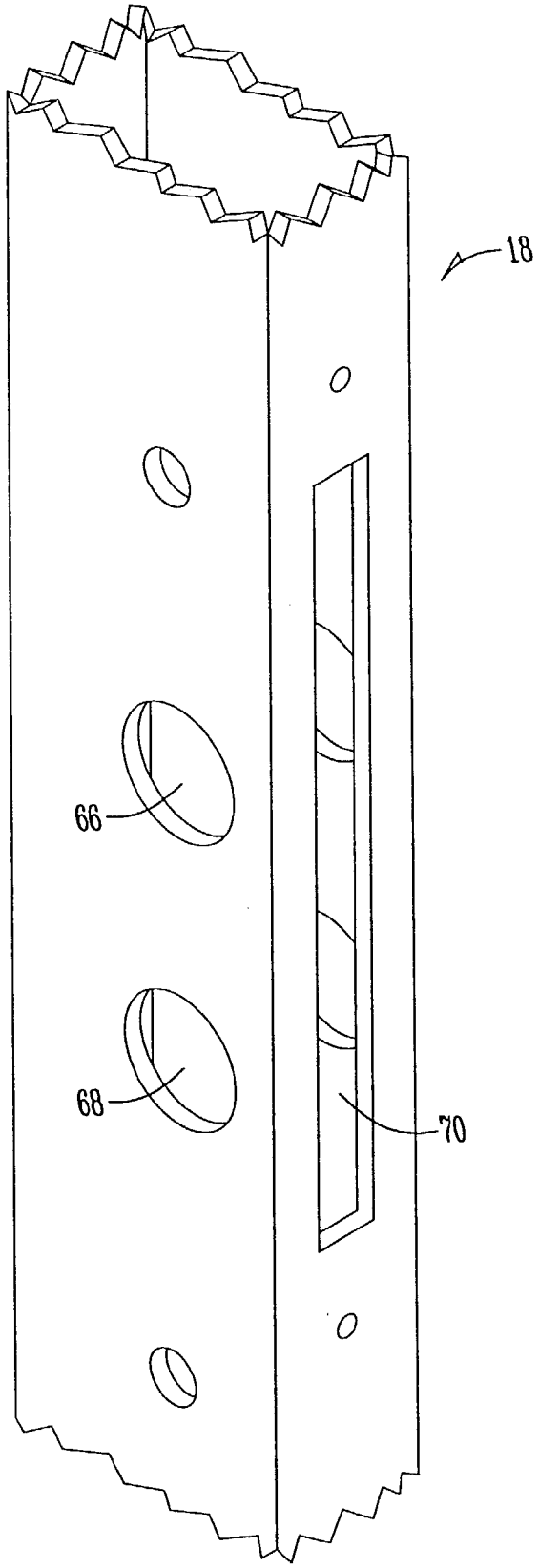
FIG. 11 is a partial perspective view of an edge of a storm door that has been prepared to receive a mortise lock according to the present invention.

Of course the entire mortise lock 20 of the present invention is installed in a properly prepared storm door 18. A properly prepared storm door 18 is shown in FIG. 11. As is shown, there are two round holes on each side or face of the storm door 18. A pair of corresponding handle holes 66 are drilled to allow for the handles 28 and 29 and the live bolt assembly 30 to be operatively connected by the handle spindle 50. There is also a pair of corresponding key cylinder holes 68. The key cylinder holes 68 allow the key cylinder 32, cam 58 and thumb turn button 34 to be operatively connected by the spindle 40. Because the key cylinder 32 has a relatively small cross-section, the key cylinder holes 68 can be easily covered up by standard escutcheon plates 25 and 27.

Figure 12:
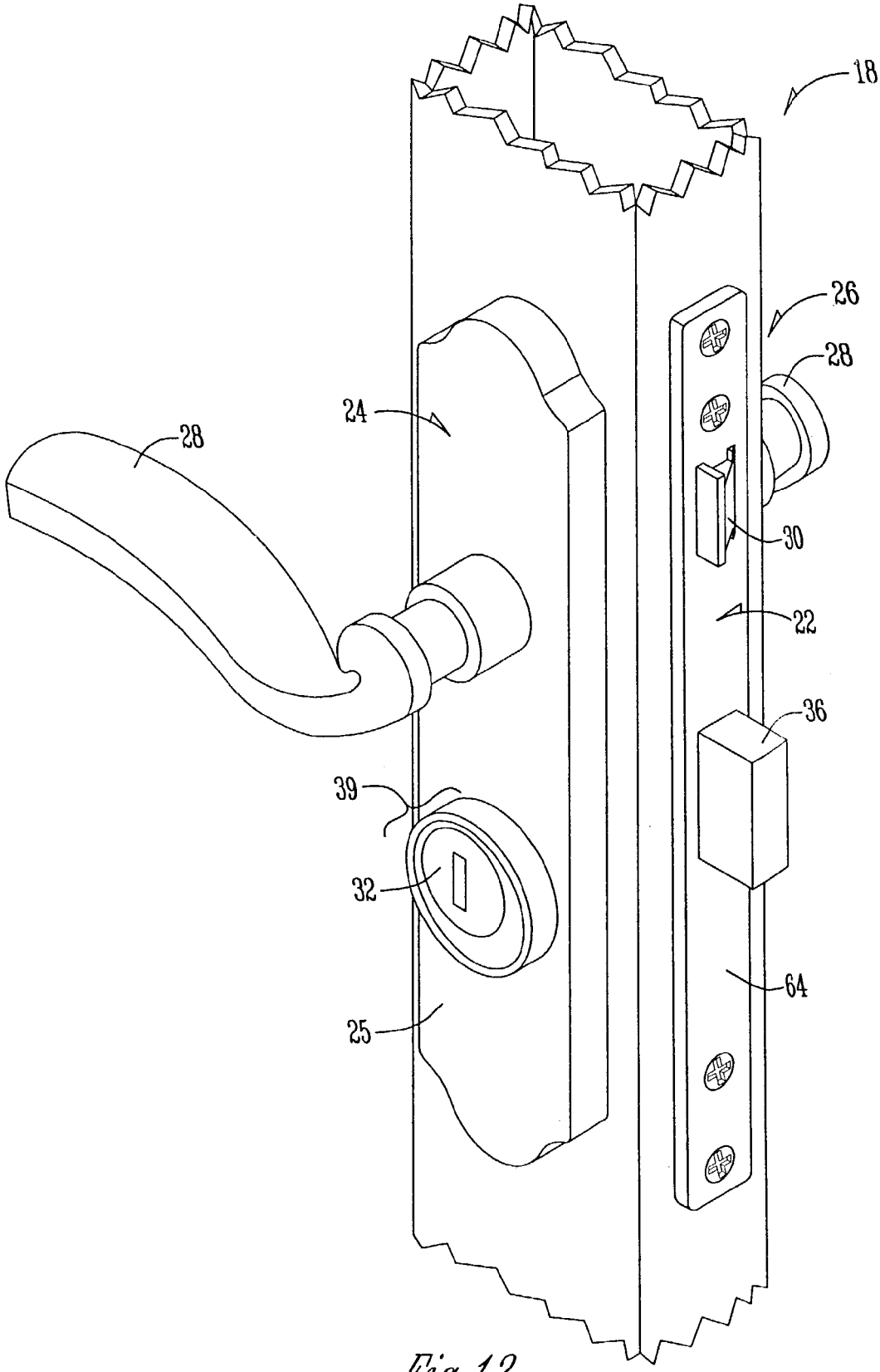
FIG. 12 is a partial perspective view of an edge of a storm door with the mortise lock of the present invention installed therein.

A mortise 70 is also made in the storm door 18 as shown in FIG. 11. This preparation allows the entire mortise lock 20 to be installed into the storm door 18 as shown in FIG. 12. Door face preparation can be done easily by an installer on-site to either side of the storm door 18. This allows the storm door 18 to be reversible without the need to flip the storm door.

A preferred embodiment of the present invention has been set forth above. It should be understood by one of ordinary skill in the art that modifications may be made in detail, especially in matters of shape, size and arrangement of parts. Such modifications are deemed to be within the scope of the present invention which is to be limited only by the broad general meaning of the terms in which the appended claims are expressed.

What is claimed is:

1. A method of installing a mortise lock in a reversible storm door, the method comprising the steps of:

providing a storm door having first and second opposing facing walls joined by left and right sidewalls;

providing a lock body including a dead bolt assembly and a cam including a cam through hole, wherein rotation of the cam actuates the dead bolt assembly;

providing first and second escutcheon plates having opposing holes and adapted for covering an exterior portion of the storm door;

providing a key cylinder with a substantially circular cross-section, the key cylinder including a spindle, a decorative portion opposite the spindle and attached to the key cylinder with a substantially circular cross-section greater than the key cylinder;

securing the key cylinder to the first escutcheon plate by placing the spindle and key cylinder through a hole in the first escutcheon plate that is larger in cross-section than the key cylinder, but smaller than the cross-section of the decorative portion, and by placing a clip into a channel in the key cylinder opposite the decorative portion to engage the first escutcheon plate;

forming a mortise in only one of the left or right sidewalls of the storm door;

forming a round hole through the storm door wherein the round hole intersects with the mortise and is larger than a cross-section of the spindle, but smaller than the first escutcheon plate;

installing the lock body in the mortise;

installing the first escutcheon plate such that the spindle goes into the round hole and intersects with the cam through hole;

providing a thumb turn button, the thumb turn button including a mounting slot;

rotatably securing the thumb turn button to the second escutcheon plate using a retaining ring: and installing the second escutcheon plate such that the spindle is received in the mounting slot of the thumb turn button;

whereby the storm door is reversible without flipping the door.

2. The method of claim 1 wherein the key cylinder has at least one key pin within the decorative portion and at least one key pin inside the first escutcheon plate.

* * * * *